US005836449A

United States Patent [19]

Peeters

[11] Patent Number: 5,836,449

[45] Date of Patent: Nov. 17, 1998

[54] RECLOSABLE PHOTOGRAPHIC SHEET PACKAGE

[75] Inventor: Dirk Peeters, Mortsel, Belgium

[73] Assignee: Agfa-Gevaert, Mortsel, Belgium

[21] Appl. No.: 786,795

[22] Filed: Jan. 21, 1997

[30] Foreign Application Priority Data

Feb. 22, 1996 [EP] European Pat. Off. ..... 96200455

[51] Int. Cl.[6] ..... B65D 85/48

[52] U.S. Cl. ..... 206/455; 206/456

[58] Field of Search ..... 206/454, 455, 206/456; 378/184

[56] References Cited

U.S. PATENT DOCUMENTS 4,413,734 11/1983 Newcombe, Jr. ..... 206/455

4,552,268 11/1985 Lee ..... 206/455

5,029,709 7/1991 Faulstick ..... 206/455

5,139,148 8/1992 Peeters et al. ..... 206/455

5,377,835 1/1995 Cornelissen et al. ..... 378/184

*Primary Examiner*—David T. Fidel

*Attorney, Agent, or Firm*—Baker & Botts, L.L.P.

[57] ABSTRACT

A reclosable photographic sheet package comprising a stack of sheets packaged in a rectangular telescope-type carton (12) having a base (13) with a neck (14) and a cover (15) telescoping over such neck, wherein the neck has a rear wall and side walls only, its front side being open to afford easy access to the sheets for removal of a sheet from the carton.

10 Claims, 3 Drawing Sheets

RECLOSABLE PHOTOGRAPHIC SHEET PACKAGE

DESCRIPTION

BACKGROUND OF THE INVENTION

1. Field of the Invention

The present invention relates to a reclosable photographic sheet package of the type comprising a telescope-type carton having a base with a neck portion and a cover telescoping over such neck portion.

2. Description of the Prior Art

A stack of medical X-ray films is commonly wrapped in a light- and moisture-tight bag that can be torn open in a controlled way. The bag fits in a telescope-type carton comprising an inner carton in the form of an open rectangular sleeve and a two-part outer carton, the lower part of the sleeve fitting in the lower part of the outer carton, i.e. the base, and being fixed thereto, and the upper portion of the sleeve forming the neck of the carton over which telescopes the upper part of the outer carton, viz. the cover of the carton. The described carton offers a good protection of the films once the bag has been opened, although an absolute lighttightness can not be guaranteed.

This known carton is expensive since most of its panels have a double-wall thickness requiring, moreover, corresponding amounts of glue. Furthermore, the fitting of the inner carton in the outer one puts high demands on the dimensional tolerances of these components.

SUMMARY OF THE INVENTION

Objects of the Invention

It is one object of the invention to provide a film package of the type referred to, which comprises less cardboard and which can be manufactured more economically.

It is a further object of the invention to provide a film package wherein the removal of a film sheet from the stack of sheets is more convenient.

Statement of the invention

In accordance with the present invention, a reclosable photographic sheet package comprising a stack of photographic sheets packed in a rectangular telescope-type carton having a base with a neck extension and a lid that telescopes over such neck, is characterised thereby that said neck has a rear wall and two side walls only, its open frontside affording easy access to the sheets for removal of a sheet from the carton.

The open frontside of the neck offers the advantage that an operator may grip and remove a sheet from the stack of packaged sheets without first having to withdraw the stack of sheets over some distance from the carton in order to be able to readily grip one sheet. This is in particular the case if the stack of sheets is wrapped in a bag, e.g. a lighttight and moisture-tight bag which is used for dually protecting the sheets prior to their first use.

Suitable embodiments of a sheet package according to the invention are as follows.

The carton is made from one cardboard blank.

A cardboard blank from which the carton is made is arranged for forming at the front side of the package a single blank thickness and at the rear side a single blank thickness at the base and a double one at the cover.

The side walls of the base have a trapezoidal shape, the bottom and top edges of each said side wall running parallel to each other, whereas at least the front or rear edges diverge towards the bottom thereby to compensate the increased depth of the top wall caused by the double wall thickness of the rear wall of the cover.

The side walls of the closed carton have a double blank thickness at the base and a triple blank thickness at the lid, and the side wall portions of the base forming the neck are stepped-in over a distance equal to one blank thickness, so that the outside surfaces of the lid and base portions of the side walls lie in one plane.

The sheet package is provided on its frontside with an easy-opening provision in the form of a zipper strip interconnecting the cover and the base prior to the first opening of the carton.

At least one of the two corners of the rear wall of the neck is rounded to facilitate replacement of the cover on the neck for reclosing the carton.

The present invention provides also an improved method for forming around a film pack a wrap-around carton of the type having a base with a neck and a separate cover fitting over said neck.

Said method is characterised by the steps of putting a cardboard blank on a suitable support, said blank having a rear panel having on opposite sides side panels connected along fold lines, a front panel having on opposite sides side panels connected along fold lines and having also a transverse weakened zone allowing it to become separated into a base and a cover portion, a bottom panel connected along fold lines with the rear and front panel respectively, a cover rearside panel having on opposite sides side panels connected along fold lines, and a top panel connected along fold lines with the front panel and the cover rearside panel respectively, putting the film pack on the front panel, folding the rear panel on the film pack, folding the cover rearside panel on the rear panel, and interconnecting the respective side panels to each other to form an all-around closed carton.

BRIEF DESCRIPTION OF THE DRAWINGS

The invention will be described hereinafter by way of example with reference to the accompanying drawings, wherein.

DETAILED DESCRIPTION OF THE INVENTION

Figure 1:
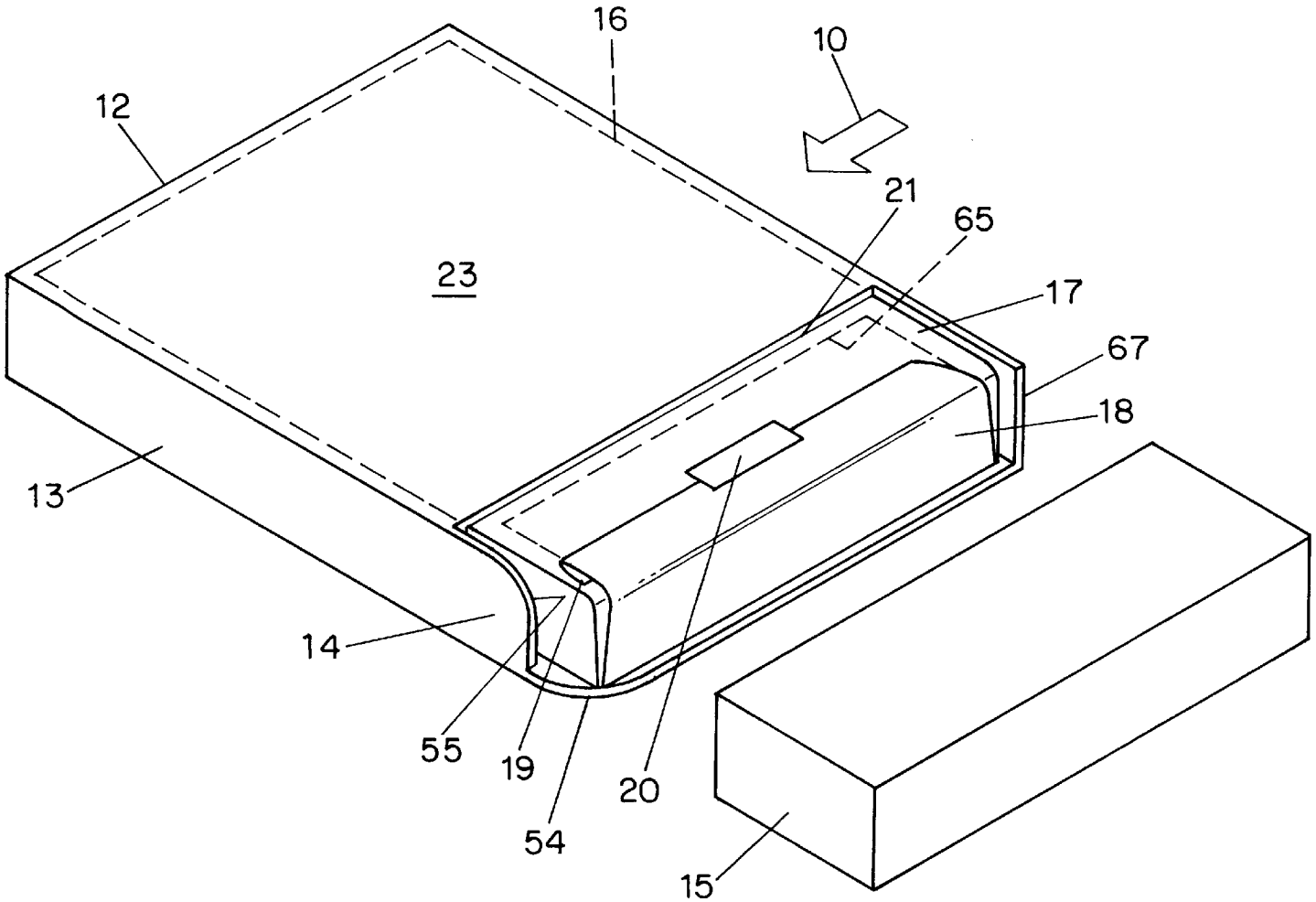
FIG. 1 is a perspective view of an opened package, the film pack being still unopened.

FIG. 1 is a diagrammatic perspective view of one embodiment of a reclosable film package 10 according to the present invention.

Rectangular carton 12, represented in drawn lines, is made from a one-piece blank of corrugated paperboard and has a base 13 with a neck 14 closable by a telescoping lid 15 which has been shown remote of the base for the sake of clarity. For the same reason, the carton has been drafted as being transparent in order to show the wrapped film pack 16 in broken lines.

The blank suitably is made of double-face corrugated fibreboard with thickness of 2 mm and a weight of 500 g/m2, which has been properly cut and scored.

The film pack comprises a stack of rectangular light-sensitive film sheets, with rounded corners as the case may be such as is common for medical X-ray film, which is wrapped in a lighttight and moisture-tight bag 17 with a tubular flap-like extension 18 which has a backfolded end 19 which is kept on the pack by means of a self-adhesive seal 20. Flap 18 forms the exit of the bag and is preferably air- and lighttightly sealed prior to first use of the package, by means of a suitable seal which may be peelable. A suitable material for the bag is a laminate consisting of the following layers in superposition: paper, aluminium and peelable polyethylene, a single or multiply black polyethylene or a similar polymer or composition. The unfolded flap takes a position as shown in broken lines 65.

Figure 2:
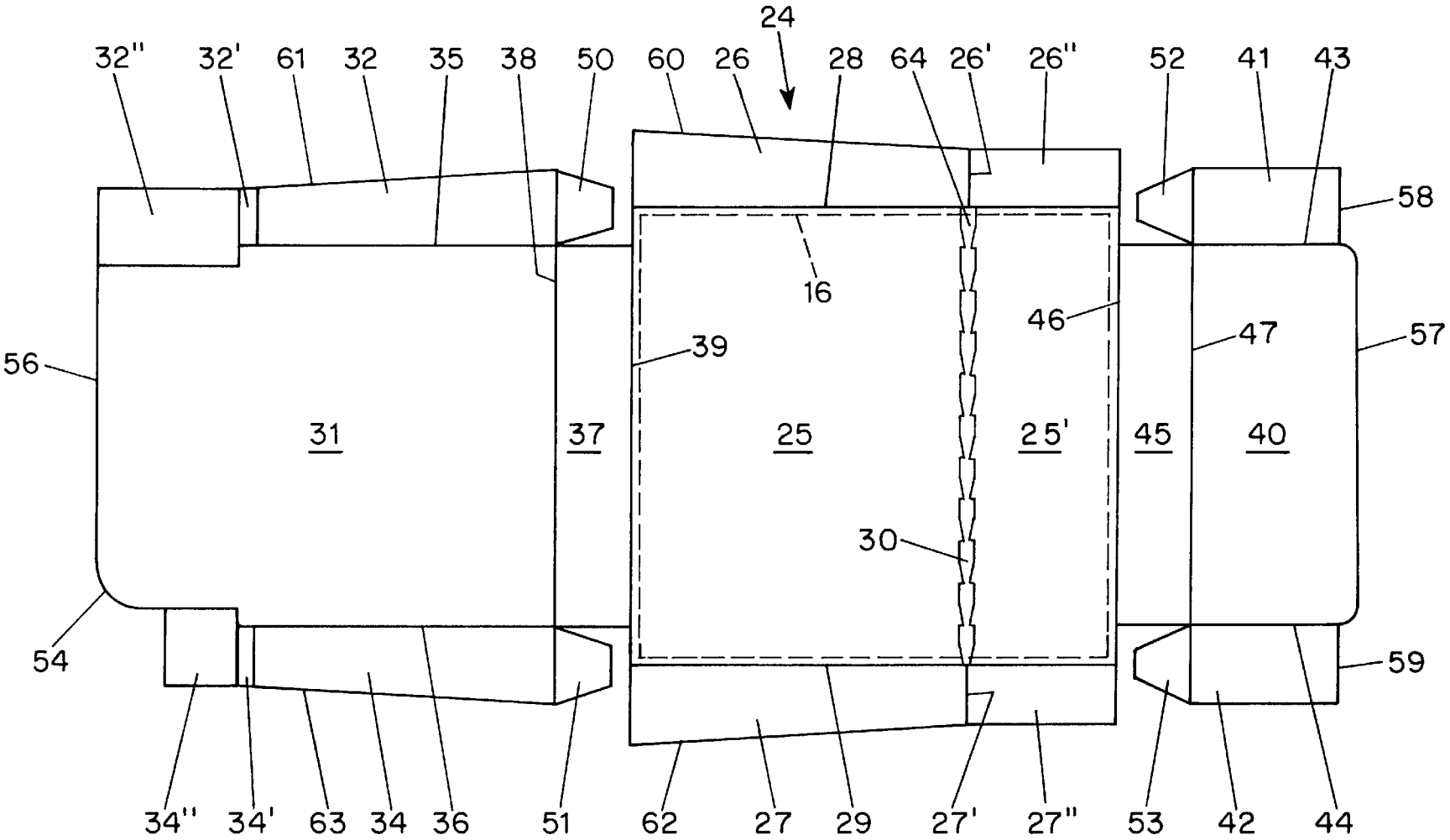
FIG. 2 is a plan view of one embodiment of a cardboard blank for producing the package according to FIG. 1.

FIG. 2 shows a one-piece blank 24 from which a carton for use in a package according to the present invention can be made.

The blank has a front panel 25 having on opposite sides side panels 26,27 connected along fold lines 28,29. The front panel is tearable in the transverse direction by suitable means, in the present embodiment a zipper strip 30, so as to allow a section 25' to become removed. Side panels 26 and 27 are cut at the height of the zipper strip, see 26' and 27' thereby forming also side panel sections 26" and 27". The blank further comprises a near panel 31 having on opposite sides side panels 32,34 connected along fold lines 35,36 and a bottom panel 37 connected along fold lines 38,39 with the rear and front panel respectively. The blank finally comprises a lid panel 40 having on opposite sides side panels 41,42 connected along fold lines 43,44, and a top panel 45 connected along fold lines 46,47 with rear panel 25 and lid panel 40, respectively.

Further details of the blank are as follows.

The side walls of the rear and cover panel have lips 50, 51, 52 and 53 connected along corresponding fold lines.

Figure 6:
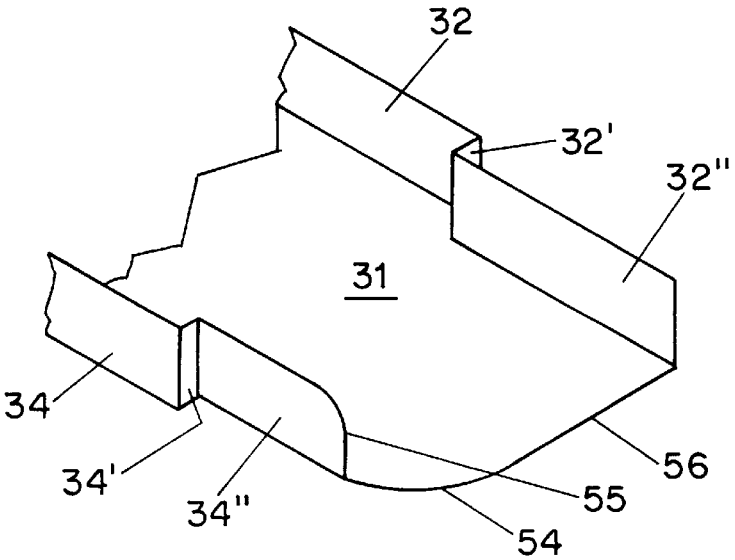
FIG. 6 is a partial perspective view of another embodiment of the neck of a package according to the invention.

The side walls 32,34 and the fold lines 35,36 of rear panel 31 are stepped, see 32' and 34', for the formation of a neck with stepped-in side walls 32" and 34" as shown enlargedly in FIG. 6.

One side wall, in the present case 34', of the rear panel is shortened for the provision of a rounded corner 54 at the top edge 56 of this panel. The free corner of side wall 34" is likewise rounded, see rounding 55.

Finally, free edge 57 of lid panel 40 extends over some distance beyond the corresponding edges 58,59 of side panels 41,42 for a reason that will be explained hereinafter.

The carton described is a wrap-around carton and its formation is as follows.

Blank 24 is laid down on a horizontal supporting surface and a film pack 16 is put on front panel 25 as shown by dashed line 16. The opening end of the bag of the pack is oriented towards top panel 45 and the backfolded flap of the pack rests on front panel 25'.

Lips 50 and 51 are folded upwardly, side panels 32 and 34 are folded upwardly, and next rear panel 31 is folded over film pack 16, bottom panel 37 being normal to both the front and rear panels and lips 50 and 51 being enclosed between bottom wall 37 and the corresponding bottom wall of the film package.

Then lips 52 and 53 are folded upwardly, side panels 41 and 42 are folded upwardly, and next lid panel 40 is folded over the already folded rear panel, top panel 45 being normal to both the front and lid panel. Side panels 41 and 42 become located on slightly recessed sections 32',34' of side panels 32,34 of rear panel 31, so that the outer surfaces of panels 32 and 41, and of 34 and 42 lie in one plane. This is desirable for the glueing step which will now follow since it allows clamping of the folded blank between two truly parallel clamping bars. Tracks of a suitable bonding agent, e.g. a hot melt adhesive, are now applied to the outside surface of side panels 32,41 and 34,42, and next side panels 26,27 are folded against the corresponding rear and lid side panels. The carton thus assembled is kept or transported between two parallel clamping bars engaging folded side panels 26,27 until the adhesive has solidified. The package is removed from the clamping installation, it is turned over to locate the front panel on top, an identifying label is attached to said front panel, and the package is ready for use.

Figure 3:
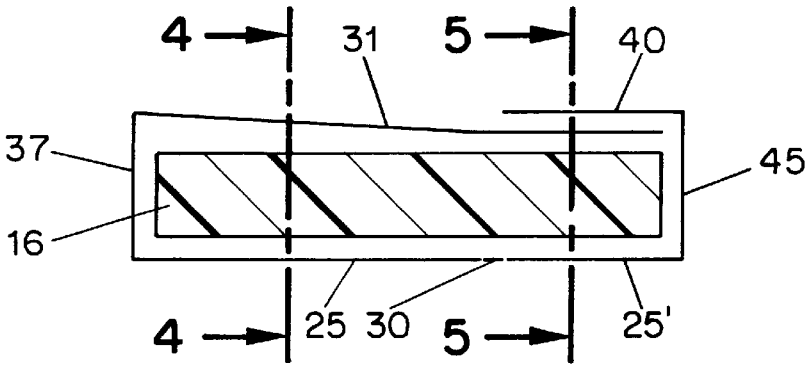
FIG. 3 is a diagrammatic longitudinal sectional view of a package made of the blank of FIG. 1.
Figure 4:
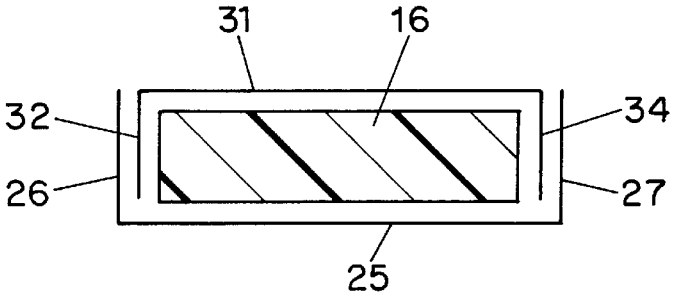
FIG. 4 is a transverse sectional view on line 4—4 of FIG. 3.
Figure 5:
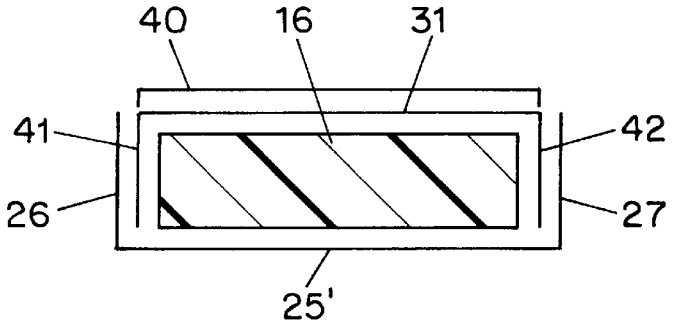
FIG. 5 is a transverse sectional view on line 5—5 of FIG. 3.

FIG. 3 is a longitudinal view and FIGS. 4 and 5 are transverse sectional views of FIG. 3 illustrating the folding of the respective panels. Adjacent panels have been shown with a large separation for the sake of clarity. FIG. 3 reveals particularly side panels 26,32 and 27,34, viz. their trapezoidal shape. Whereas their top edges run parallel to each other, their side edges 60, 61, 62 and 63 are slightly diverging with respect to corresponding fold lines 28, 35, 29 and 36 in the direction of bottom panel 37, see FIG. 2. As a consequence thereof, rear panel 31 is slightly slanting with respect to front panel 25 so that in spite of the thickness of panel 40 added to panel 31, the depth of top panel 45 equals that of bottom panel 37, see FIG. 3. This is desirable in view of the loading of the sheet packages in a so-called shipping carton. Usually, 5 or more sheet packages are put in one shipping carton, the packages lying on one side since in this way the height of the carton is determined by the width of the films instead of by their height. The lower point of gravity provides a better stability of the shipping cartons during their manipulation. However, if in such position of the packages the depth of the bottom panels 37 is smaller than that of the top panels 45, there is some play between the bottom ends of adjacent packages which may be undesirable. The measure described hereinbefore obviates such play.

Opening of a sheet package described hereinbefore, occurs as follows.

The operator puts the package on a desk in the darkroom, the front side facing up, graps zipper strip 30 with its leading end 64, and then pulls the strip away. Lid 15 has now become separated from base 12 and can be taken away.

Seal 20 is broken or removed, and flap 18 is unfolded so that the operator can introduce his fingers in the bag and grasp and remove the upper sheet from the stack of sheets. It should be noted that this operation is considerably easier than in conventional packages where also the front side of the neck is closed and where in consequence the bag must partly be withdrawn from the base in order to provide sufficient finger space for grasping a sheet.

The package can be reclosed by backfolding the flap completely on the film pack as shown by broken line 65. The length of the flap may be such that it is not able to enter under the front wall 23, but it may also be longer so that the operator has to insert the leading flap end under such wall. Next, cover 15 is slid over the neck 14 and in that way keeps flap 18 closed. Replacing the cover may be facilitated if one corner of the neck exit has been given a rounded shape, see curvature 54, which may have a radius between one and several centimeters. The cover is placed first over the opposite edge 67 and then progressively advanced towards the base, the contact of corner 54 with the corresponding inside of panel 42 smoothly guiding the cover over the neck. Replacement of the cover is further facilitated by having the free corner of side wall 34" rounded too, see 55.

It should be noted that removal of zipper strip 30 left an opening with a width that in practice will range from 5 to 10 mm approximately. This may be detrimental to the appearance of the carton and may suggest that lighttightness has become doubtful whereas actually it is not. Therefore, according to a sub-aspect of the invention, the cover is turned over as it is replaced on the neck so that now its projecting edge 57, as compared with the adjacent edges 58,59 of its side walls fits in the opening left by the removed zipper strip. This may give a more reassuring feeling to the user.

Finally, it should be noted that lid panel 40 of the cover, or panel section 25' of a turned-over cover as the case may be, lie on rear panel 31 instead of being flush therewith as in usual telescoping X-ray cartons. This is without importance and it can even be an advantage since if the cover is firmly fitting on the neck, an operator who is pulling the cover grasps with the finger tips behind the free edge of the cover rear panel, whereby a larger force can be exerted than if the fingers would frictionally engage such panel surface.

It has been shown that deformation of said walls 32,34 to obtain stepped-in sections 32',34' did not deteriorate the carton. This is undoubtedly due to the use of corrugated cardboard for the manufacturing of the carton, which allows substantial deformations without getting torn.

A reclosable sheet package according to the present invention is not limited to the described embodiment.

Side panels 32,34 need not necessarily be stepped as shown but may also remain straight. In such case the triple panel thickness of the side walls of the lid, as compared with the double panel thickness of the side walls of the base, will produce an increased width of the lid which may be less desirable for the appearance of the carton and for the clamping of the side walls for their glueing, as described hereinbefore.

The interengagement of the side panels near the top and bottom panels may be different. As an example we refer to our U.S. Pat. No. 5,377,835 entitled "Reclosable film package" wherein a blank without lips such as 50, 51, 52 and 53 has been shown.

Free edges of the carton such as edges 56,57,60 and 62 may be cut according to a slightly wave-like pattern rather than truly straight in order to reduce the injury hazard for the customers fingers during handling of the package.

The stack of sheets must not necessarily be wrapped in a bag as shown but may also be wrapped in a simple wrapping foil, or kept together prior to its first use by a hooping strap. The latter wrappings can be used if the sheets are not light-sensitive, e.g. sheets used for thermography.

Finally, zipper closure 30 can be replaced by equivalent opening systems such as tear strips or the like.

I claim:

1. A reclosable photographic sheet package comprising:

a stack of photographic sheets and a rectangular telescope-type carton made from one cardboard blank and having (i) a base with a neck extension and (ii) a cover telescoping over said neck extension, said neck extension of the base having a rear wall and two side walls only and being open at a front side so as to afford easy access to the sheets for removal of sheets from the carton.

2. The reclosable photographic sheet package according to claim 1, wherein said package has a front side and a rear side and said cardboard blank is arranged for forming in its closed position a single blank thickness at said front side, a single blank thickness at said rear side at said base, and a double blank thickness at said rear side at said cover.

3. The reclosable photographic sheet package according to claim 2, wherein:

said carton has a bottom, said cover has a rear wall, and said base has side walls, each side wall of said base having a top, a bottom, a front, and a rear edge and being of trapezoidal shape, the bottom and top edges of each said side wall being parallel to each other whereas at least the front or rear edges diverge towards the bottom of said carton so as to compensate for the increased depth of the rear wall of the cover caused by the double blank thickness at said cover.

4. The reclosable photographic sheet package according to claim 2, wherein:

said cover has side walls and said base has side walls, said side walls of said base having a double blank thickness at said base and a triple blank thickness at said cover, and said side walls of said neck extension being stepped-in over a distance equal to one blank thickness, such that the outside of said side walls of said cover and the outside of said side walls of said base lie in the same plane.

5. The reclosable photographic sheet package according to claim 1, wherein said rear wall of said neck extension has corners, at least one of which is rounded to facilitate placement of the cover back on the neck extension so as to reclose the carton.

6. The reclosable photographic sheet package according to claim 1, wherein said carton is a wrap-around carton.

7. The reclosable photographic sheet package according to claim 1, wherein said stack of photographic sheets is wrapped in a lighttight bag having an exit extension in the form of a flap folded back on the bag.

8. The reclosable photographic sheet package according to claim 7, wherein the length of the flap is such that said backfolded flap has a length that does not engage the front side of the package.

9. The reclosable photographic sheet package according to claim 1, which is provided on its front side with an easy-opening provision in the form of a zipper strip interconnecting the cover with the base prior to the first opening of the carton.

10. The reclosable photographic sheet package according to claim 5, wherein the radius of said rounded corner is at least 1.0 cm.

* * * * *